US007479041B1

(12) United States Patent
Chen

(10) Patent No.: US 7,479,041 B1
(45) Date of Patent: Jan. 20, 2009

(54) MOBILE MEMORY CARD ADAPTER

(75) Inventor: I-Ming Chen, Taipei (TW)

(73) Assignee: Singim International Corp., Taipei Hsien (TW)

( * ) Notice: Subject to any disclaimer, the term of this patent is extended or adjusted under 35 U.S.C. 154(b) by 0 days.

(21) Appl. No.: 12/056,268

(22) Filed: Mar. 26, 2008

(51) Int. Cl.
*H01R 24/00* (2006.01)

(52) U.S. Cl. ..... 439/630; 439/528

(58) Field of Classification Search ..... 439/631, 439/630, 632, 541.5, 528
See application file for complete search history.

(56) References Cited

U.S. PATENT DOCUMENTS 7,029,306 B2 * 4/2006 Bilcauu et al. ..... 439/326
7,351,081 B1 * 4/2008 Lai ..... 439/159
7,357,653 B2 * 4/2008 Hung et al. ..... 439/138
2006/0251457 A1 * 11/2006 Lapstun et al. ..... 400/88

* cited by examiner

*Primary Examiner*—Neil Abrams
*Assistant Examiner*—Phuong Nguyen

(57) ABSTRACT

A mobile memory card adapter includes a housing having an insertion hole, a circuit board that is accommodated in the housing and has a fixed connection interface extending out of one end of the housing and a movable adapter interface connected thereto with a cable and extendable to the outside of the housing at a distance, and multiple conducting terminal sets each having an insulative block detachably fastened to the circuit board and multiple metal conducting terminals kept in contact with respective conducting contacts of the circuit board and suspending in the insertion hole of the housing for the contact of a corresponding memory card that is selected by the user and inserted into the insertion hole to let the inserted memory card be electrically connected to an external electronic device through the fixed connection interface or the movable adapter interface.

12 Claims, 8 Drawing Sheets

MOBILE MEMORY CARD ADAPTER

BACKGROUND OF THE INVENTION

1. Field of the Invention

The present invention relates to a mobile memory card adapter adapted for connecting a memory card to an electronic device and more particularly, to such a mobile memory card adapter, which fits different types of memory cards and has a fixed connection interface and a movable adapter interface for connecting the inserted memory card to an electronic device selectively.

2. Description of the Related Art

Following fast development of high technology, a variety of high-tech electronic devices have been developed and have appeared on the market. These electronic devices such as computers, mobile telephones, PDAs, digital cameras and etc. provide sophisticated functions to satisfy different demands. Further, these electronic devices commonly have a card connector for receiving a memory card for storing document data or static/motion video data. Following the market trend toward light, thin, short and small electronic device characteristics, many small size memory cards have been developed.

Further, a memory card must be installed in a computer compatible card reader so that a computer is accessible to the memory card. It is inconvenient to carry a memory card with a card reader. To eliminate this problem, many mobile sticks and the likes that combine a memory device and a card reader into one compact unit are created. Further, mobile memory card adapters have also been developed and adapted for connecting different types of memory cards to a computer or electronic device. Regular memory cards include big size types of CF (Compact Flash Card) and SM (Smart Media Card) and small size types of MMC (MultiMedia Card), MS (Memory Stick), SD (Secured Digital Memory Card) and etc. By means of connecting a mobile memory card adapter to a computer or an electronic device, a user can expand the data storage space of the computer or the electronic device.

Further, the metal conducting terminals of a memory card adapter are directly bonded to the metal contacts of the circuit board of the memory card adapter by means of spot soldering or reflow soldering. This metal conducting terminal installation procedure wastes much time and labor, and may encounter the problem of missing solder or flooding of solder. Further, when wishing to detach the metal conducting terminals from the circuit board, a desoldering procedure is necessary. However, this desoldering procedure requires much time and labor and causes environmental pollution.

Further, a mobile memory stick or memory card adapter generally has only one connection interface for connection to a specific connection port or interface of a computer or electronic device. For connecting a mobile memory stick or memory card adapter to a different type of connection port, an adapter must be used.

SUMMARY OF THE INVENTION

The present invention has been accomplished under the circumstances in view. According to one aspect of the present invention, the mobile memory card adapter is comprised of a housing, a circuit board mounted inside the housing, and multiple conducting terminal sets installed in the circuit board to fit different memory cards. The circuit board comprises multiple sets of conducting contacts for the connection of the conducting terminal sets respectively, a fixed connection interface outwardly extending from one end thereof to the outside of the housing and electrically connected to the conducting contacts and adapted for connection to an external electronic device, a cable electrically connected with the conducting contacts and extendable out of the housing, and a movable adapter interface electrically connected to one end of the cable remote from the conducting contacts and adapted for connection to an external electronic device and receivable in a receiving space of the housing.

According to another aspect of the present invention, the housing comprises a bottom shell that accommodates the circuit board, an upper shell covering the bottom shell, a top cover pivoted to and closed on the upper shell, and a bottom cover adapted to close the receiving space that is defined in the bottom shell. The bottom shell comprises two pivots disposed at two opposite lateral sides in the receiving space, two retaining blocks disposed remote from the pivots, a partition plate transversely disposed in the receiving space near the pivots, and a wire notch on the partition plate for the passing of the cable of the movable adapter interface. The bottom cover comprises two pivot holes bilaterally disposed at the rear side thereof and respectively pivotally coupled to the pivots of the bottom shell, two retaining grooves disposed at the front side thereof remote from the pivot holes for engagement with the retaining blocks of the bottom shell, and a finger strip disposed between the two retaining grooves for the grasping of the user's fingers to turn the bottom cover relative to the bottom shell between a close position where the bottom cover close the receiving space to protect the movable adapter interface in the receiving space against outside dust and an open position where the receiving space is opened for enabling the movable adapter interface to be extended out of the housing for connection to an external electronic device.

DETAILED DESCRIPTION OF THE PREFERRED EMBODIMENT

Figure 1:
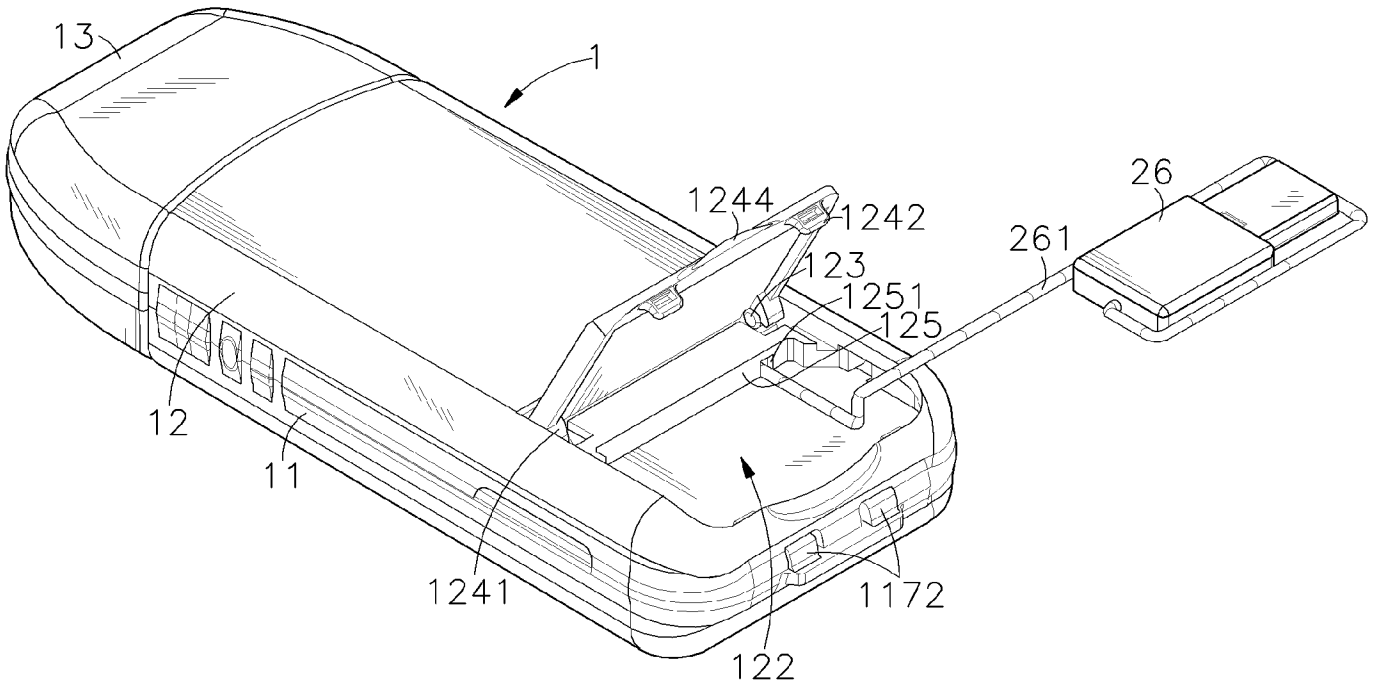
FIG. 1 is an elevational view of a mobile memory card adapter in accordance with the present invention.
Figure 2:
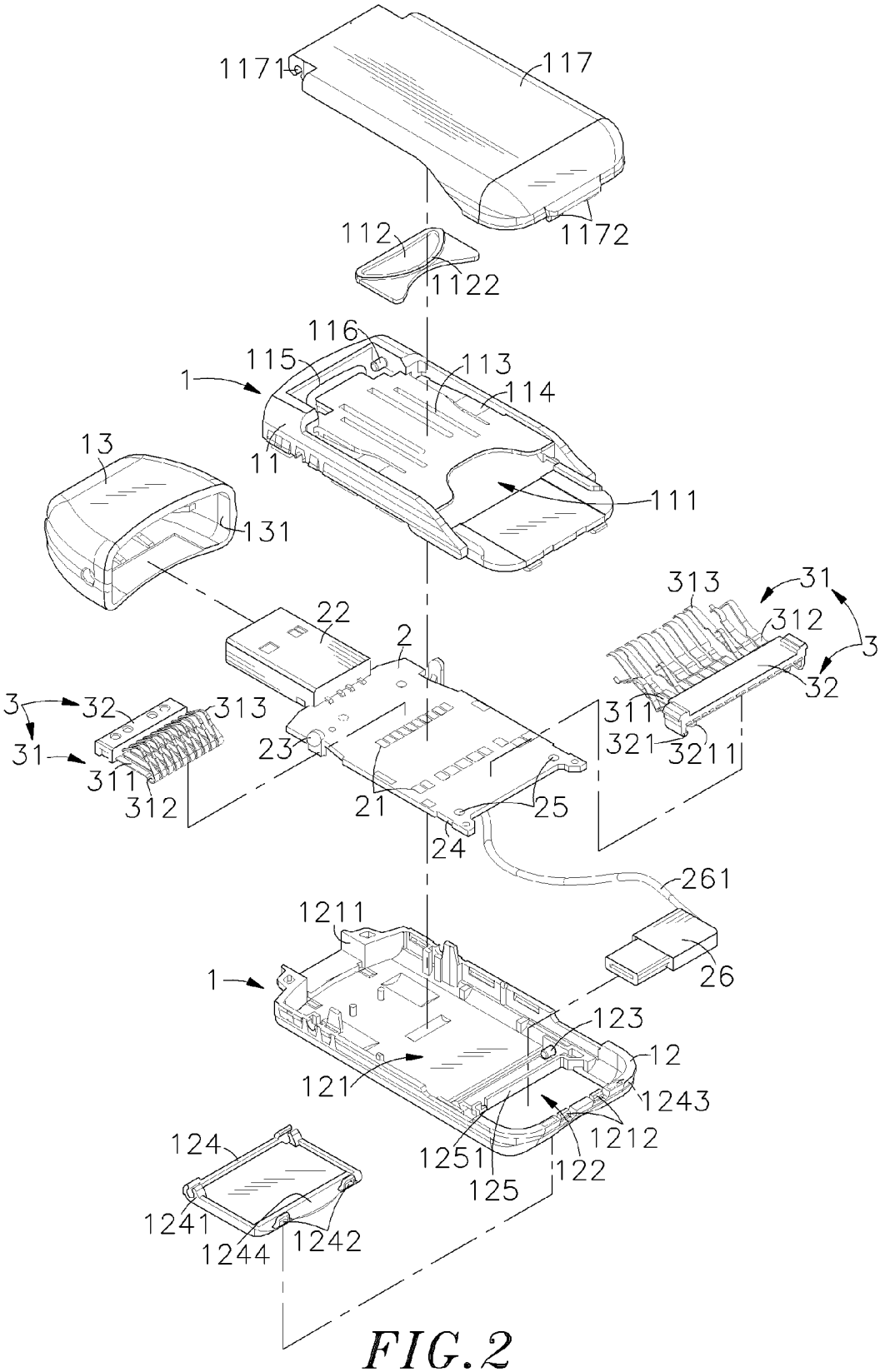
FIG. 2 is an exploded view of the mobile memory card adapter in accordance with the present invention.
Figure 3:
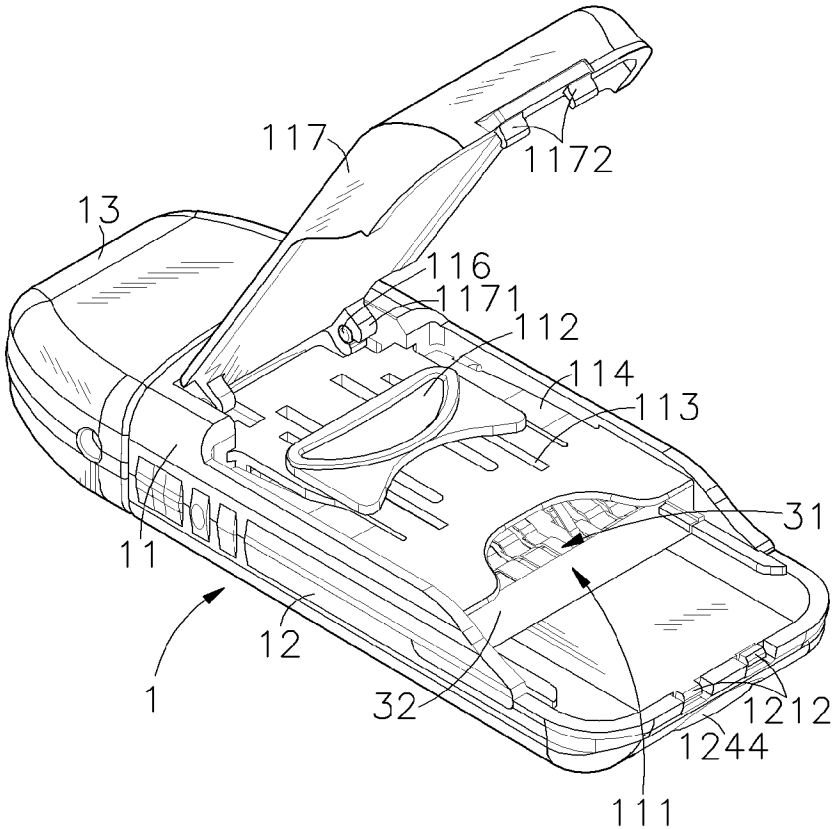
FIG. 3 is another elevational view of the mobile memory card adapter in accordance with the present invention, showing the top cover of the housing opened from the upper shell.

Referring to FIGS. 1~3, a mobile memory card adapter in accordance with the present invention is shown comprising a housing 1, a circuit board 2 and conducting terminal sets 3.

The housing 1 is comprised of an upper shell 11, a slide 112, a top cover 117, a bottom shell 12, a bottom cover 124 and a protective end cap 13.

The upper shell 11 has an insertion hole 111, an opening 115 disposed near one end thereof, two pivots 116 aligned at two opposite lateral sides in the opening 115, two oblique spring arms 114 bilaterally suspending in the insertion hole 111 at two opposite lateral sides, and a plurality of sliding slots 113 arranged in parallel above the insertion hole 111.

The slide 112 has a plurality guide members 1121 extending from the bottom wall thereof and respectively coupled to the sliding slots 113 to guide movement of the slide 112 relative to the upper shell 11 along the sliding slots 113 (see FIG. 4), and a finger rod 1122 upwardly extending from the top wall thereof.

The top cover 117 has two pivot holes 1171 bilaterally disposed at one end thereof and respectively pivoted to the pivots 116 of the upper shell 11, and a plurality of retaining blocks 1172 disposed at the other end thereof.

The bottom shell 12 has an accommodation chamber 121 defined therein and adapted for accommodating the circuit board 2, an opening 1211 disposed in communication with the accommodation chamber 121 at one side thereof, a plurality of locating blocks 1212 disposed at an opposing side thereof remote from the opening 1211 for engagement with the retaining blocks 1172 of the top cover 117, a receiving space 122 disposed near the rear side between the accommodation chamber 121 and the locating blocks 1212, two pivots 123 disposed at two opposite lateral sides in the receiving space 122 near the accommodation chamber 121, two retaining blocks 1243 disposed at two opposite lateral sides relative to the locating blocks 1212, a partition plate 125 transversely disposed in the receiving space 122 near the pivots 123, and a wire notch 1251 on the partition plate 125.

The bottom cover 124 is adapted for closing the receiving space 122 of the bottom shell 12, having two pivot holes 1241 bilaterally disposed at a rear side thereof and respectively pivotally coupled to the pivots 123 of the bottom shell 12, two retaining grooves 1242 disposed at a front side thereof remote from the pivot holes 1241 for engagement with the retaining blocks 1243 of the bottom shell 12 when the bottom cover 124 is closed on the bottom shell 12, and a finger strip 1244 disposed between the two retaining grooves 1242 for the grasping of the user's fingers to turn the bottom cover 124 relative to the bottom shell 12 between the close position where the retaining grooves 1242 are respectively forced into engagement with the retaining blocks 1243 and the open position where the retaining grooves 1242 are respectively disengagement from the retaining blocks 1243 and the bottom cover 124 is opened from the receiving space 122 of the bottom shell 12.

The protective end cap 13 has a coupling groove 131 by which the protective end cap 13 is capped on the front side of the upper shell 11 and the front side of the bottom shell 12.

The circuit board 2 is accommodated in the accommodation chamber 121 of the bottom shell 12, having multiple conducting contacts 21, a connection interface 22 outwardly extending from one end thereof, two indicator lights 23 arranged at two opposite lateral sides thereof near the connection interface 22, a plurality of retaining grooves 24 symmetrically disposed at the two opposite lateral sides, a plurality of mounting holes 25 cut through the top and bottom sides thereof and respectively disposed adjacent to the retaining grooves 24, and a cable 261 electrically connected thereto and terminating in an adapter interface 26.

Each conducting terminal set 3 comprises parallel metal conducting terminals 31 stamped from a metal strip material (not shown), and an insulative block 32 molded on the metal strip material by means of insert molding. Each metal conducting terminal 31 has an elongated base portion 311 fastened to the insulative block 32, a bearing portion 312 curved from one end of the elongated base portion 311 remote from the insulative block 32, and a contact portion 313 extended from one end of the bearing portion 312 opposite to the elongated base portion 311. The insulative block 32 has a plurality of bottom mounting pins 3211, and two retaining portions 321 respectively extended from the two distal ends thereof.

During installation, the circuit board 2 is accommodated in the accommodation chamber 121 of the bottom shell 12 to have the connection interface 22 be extended out of the opening 1211 of the bottom shell 12 and the opening 115 of the upper shell 11 and the indicator lights 23 be respectively inserted into the respective side holes (not shown) on the upper shell 11 and the bottom shell 12, and then the retaining portions 321 of the insulative blocks 32 of the conducting terminal sets 3 are respectively fastened to the retaining grooves 24 of the circuit board 2 to force the bottom mounting pins 3211 of the insulative blocks 32 of the conducting terminal sets 3 into the mounting holes 25 of the circuit board 2 respectively. At this time, the bearing portions 312 of the metal conducting terminals 31 of the conducting terminal sets 3 are respectively supported on and kept in contact with the conducting contacts 21 of the circuit board 2 respectively, and the contact portions 313 of the metal conducting terminals 31 of the conducting terminal sets 3 are respectively suspending in the insertion hole 111 of the upper shell 11. Thereafter, the pivot holes 1171 of the top cover 117 are respectively pivoted to the pivots 116 of the upper shell 11, and then the top cover 117 is closed on the upper shell 11 to force the retaining blocks 1172 into engagement with the locating blocks 1212 of the bottom shell 12, and then the adapter interface 26 is received in the receiving space 122 in the bottom shell 12 to have the cable 261 be extended through the wire notch 1251 on the partition plate 125 and wound around the adapter interface 26 and received with the adapter interface 26 in the receiving space 122, and then the pivot holes 1241 of the bottom cover 124 are respectively coupled to the pivots 123 of the bottom shell 12 and the bottom cover 124 is then closed on the bottom shell 12 to force the retaining grooves 1242 into engagement with the respective retaining blocks 1243, keeping the adapter interface 26 from sight and well protected. At final, the protective end cap 13 is capped on the upper shell 11 and the bottom shell 12.

According to the present preferred embodiment, the upper shell 11 and the bottom shell 12 are two separate members detachably fastened together. Alternatively, the upper shell 11 and the bottom shell 12 can be made in integrity. Further, the conducting interface 22 can be an IEEE 1394 connector, USB connector or any of a variety of other signal transmission connectors. Further, the insulative block 32 of each conducting terminal set 3 can be a single-piece insulative block directly molded on the metal strip material. Alternatively, the insulative block 32 can be formed of two symmetrical parts that are respectively attached to two opposite sides of the metal strip material and then fastened together. By means of the insulative blocks 32, the conducting terminal sets 3 are fastened to the circuit board 2 without soldering. After the insulative blocks 32 of the conducting terminal sets 3 have been affixed to the circuit board 2, the bearing portions 312 of the metal conducting terminals 31 are respectively supported on and kept in contact with the respective conducting contacts 21 of the circuit board 2, and the contact portions 313 of the metal conducting terminals 31 are kept suspending in the insertion hole 111 in the upper shell 11. This installation procedure saves much labor and time. Because this installation procedure eliminates soldering, the invention eliminates the problems of missing solder and flooding of solder, prevents short circuit, and effectively improves the yield rate.

Figure 4:
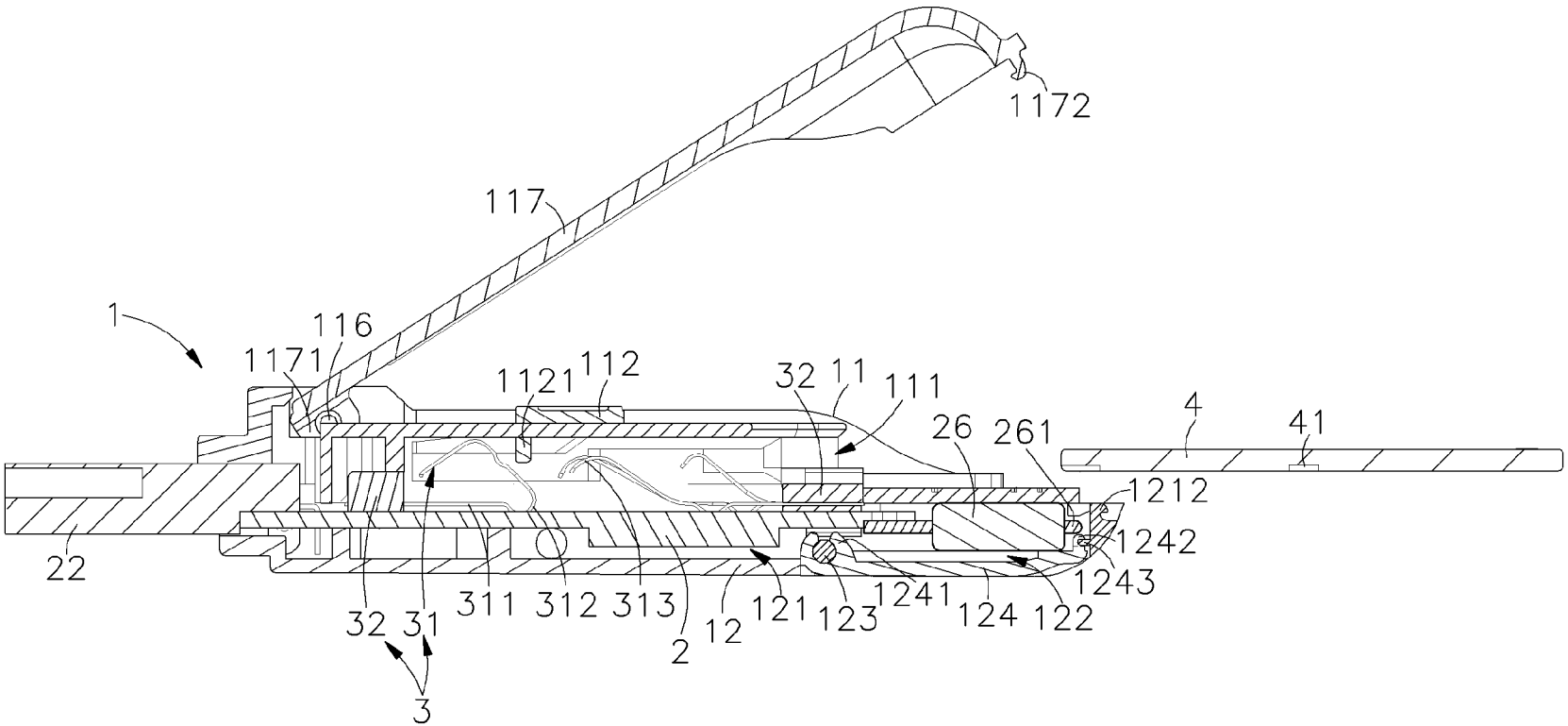
FIG. 4 is a sectional side view of the mobile memory card adapter in accordance with the present invention, showing the top cover of the housing opened from the upper shell before insertion of the selected memory card and after removal of the protective end cap.
Figure 5:
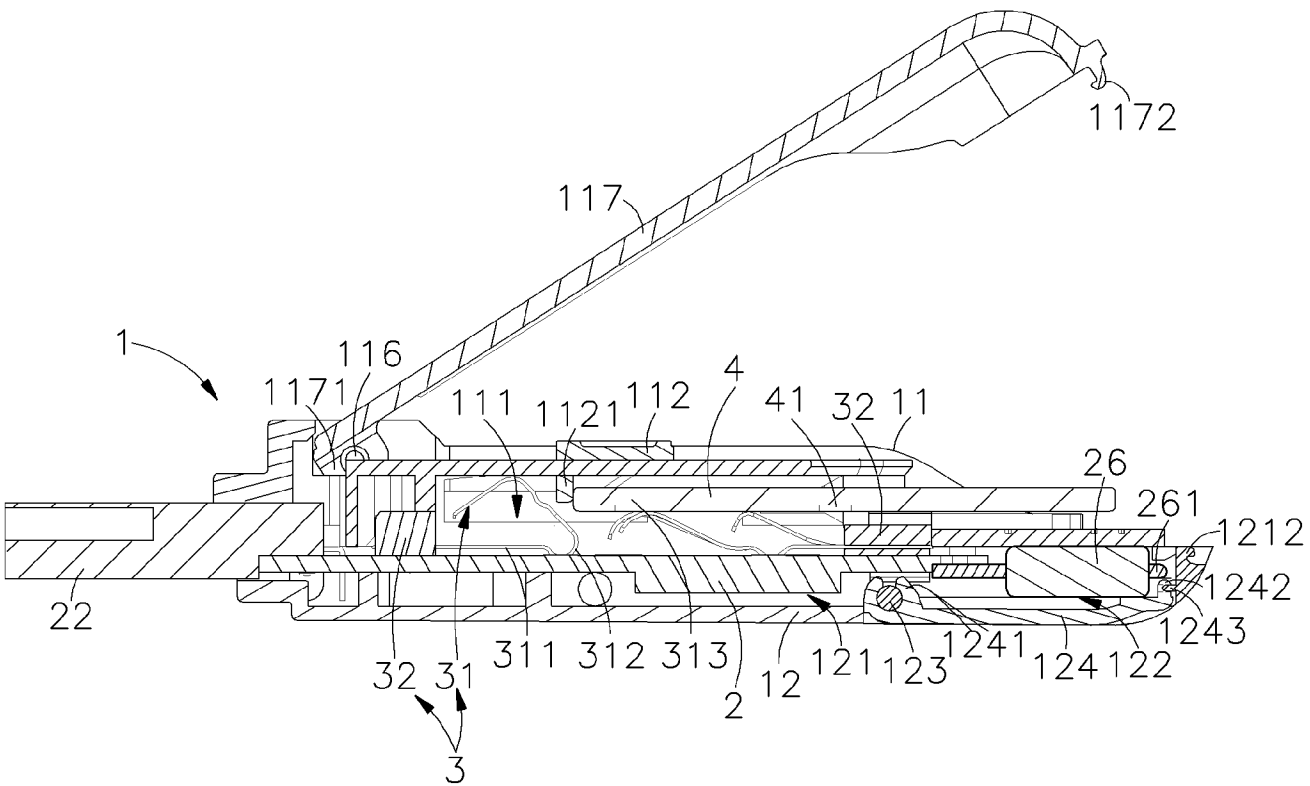
FIG. 5 corresponds to FIG. 4, showing the selected memory card partially inserted into the insertion hole of the upper shell of the housing.
Figure 6:
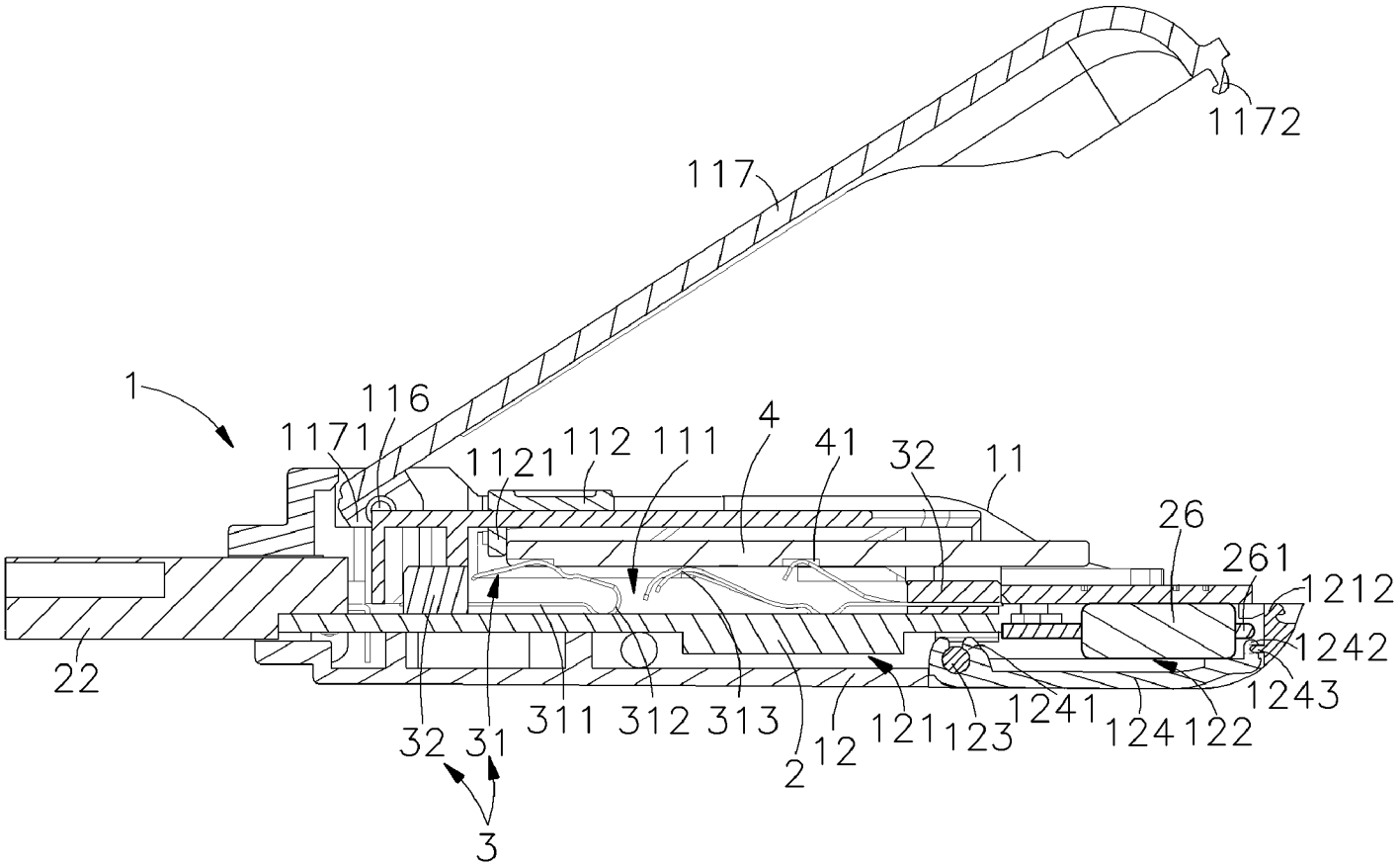
FIG. 6 corresponds to FIG. 5, showing the selected memory card fully inserted into the insertion hole of the upper shell of the housing and kept in contact with the corresponding conducting terminal set.

Referring to FIGS. 4, 5 and 6, when in use, a memory card 4 is inserted into the insertion hole 111 of the upper shell 11 to push the guide members 1121 of the slide 112, moving the slide 112 toward the deep inside of the insertion hole 111. When the memory card 4 is set into position, a plurality of metal contacts 41 of the memory card 4 are respectively set into contact with the contact portions 313 of the metal conducting terminals 31 of the corresponding conducting terminal set 3, and the spring arms 114 are respectively pressed on the memory card 4, holding the memory card 4 in position. At this time, the memory card 4 imparts a downward pressure to the metal conducting terminals 31 of the corresponding conducting terminal set 3, enhancing the contact connection between the bearing portions 312 of the respective metal conducting terminals 31 and the respective conducting contacts 21 of the circuit board 2. Thus, the storage data of the memory card 4 is transmittable through the respective conducting contacts 21 and the connection interface 22 of the circuit board 2 to an external electronic device (not shown) to which the connection interface 22 is connected.

When wishing to take the memory card 4 away from the housing 1, pull the finger rod 1122 of the slide 112 (see FIG. 2) to move the slide 112 toward the outside of the insertion hole 111, and therefore the memory card 4 is forced out of the insertion hole 111 by the slide 112. Further, according to the present preferred embodiment, there are two terminal sets 3 installed in the circuit board 2, i.e., two different types of memory cards 4 are selectively usable with the mobile memory card adapter of the present invention.

Further, when the selected memory card 4 is inserted into the housing 1, the spring arms 114 are respectively pressed on the inserted memory card 4 to hold the inserted memory card 4 stably in position, and therefore the bearing portions 312 of the respective metal conducting terminals 31 are firmly kept in contact with the respective conducting contacts 21 of the circuit board 2, preventing short circuit or contact failure. In case of elastic fatigue of the metal conducting terminals 31 due to a long use, the spring force of the spring arms 114 is still sufficient to hold down the inserted memory card 4 firmly in position, keeping the metal contacts 41 of the memory card 4 in positive contact with the contact portions 313 of the metal conducting terminals 31 of the corresponding conducting terminal set 3. Therefore, the mobile memory card adapter of the present invention has the characteristics of long service life and low failure rate.

On the other hand, when changing the mode of use of the circuit board 2, the insulative blocks 32 of the conducting terminal sets 3 can be detached from the circuit board 2, and then the metal conducting terminals 31 can be respectively and directly bonded to the circuit board 2, saving much the cost.

Figure 7:
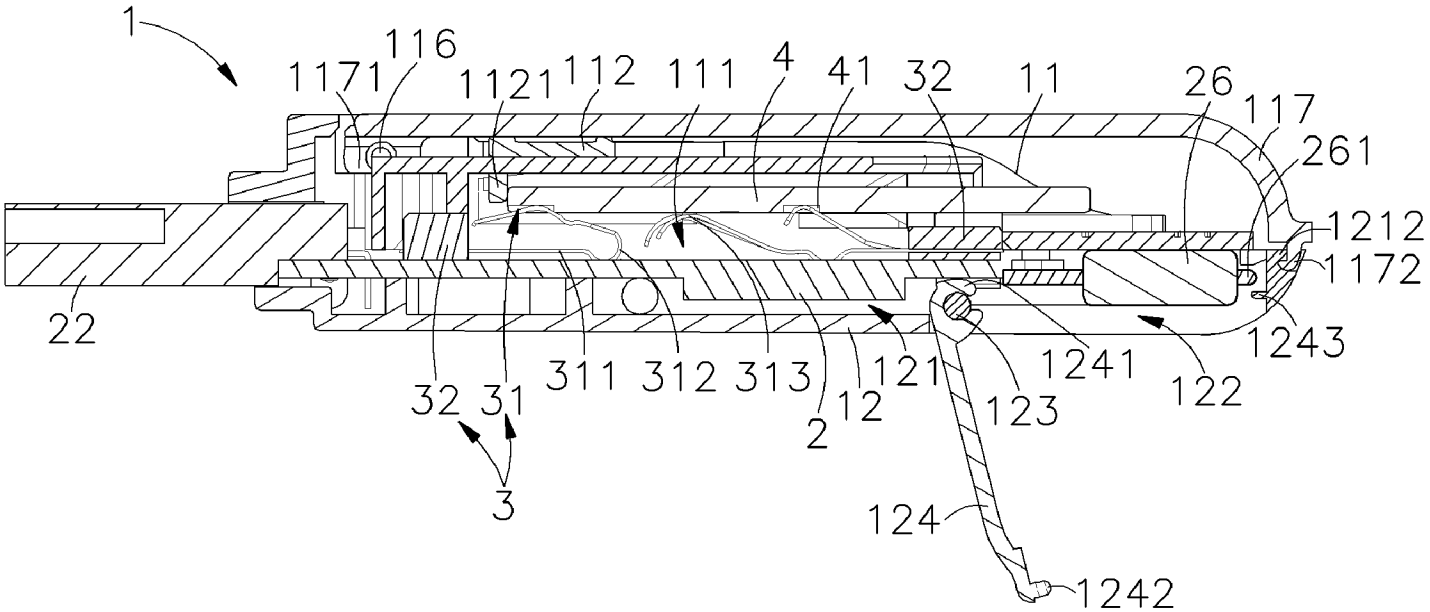
FIG. 7 corresponds to FIG. 6, showing the top cover closed on the upper shell and the bottom cover opened from the bottom shell.
Figure 8:
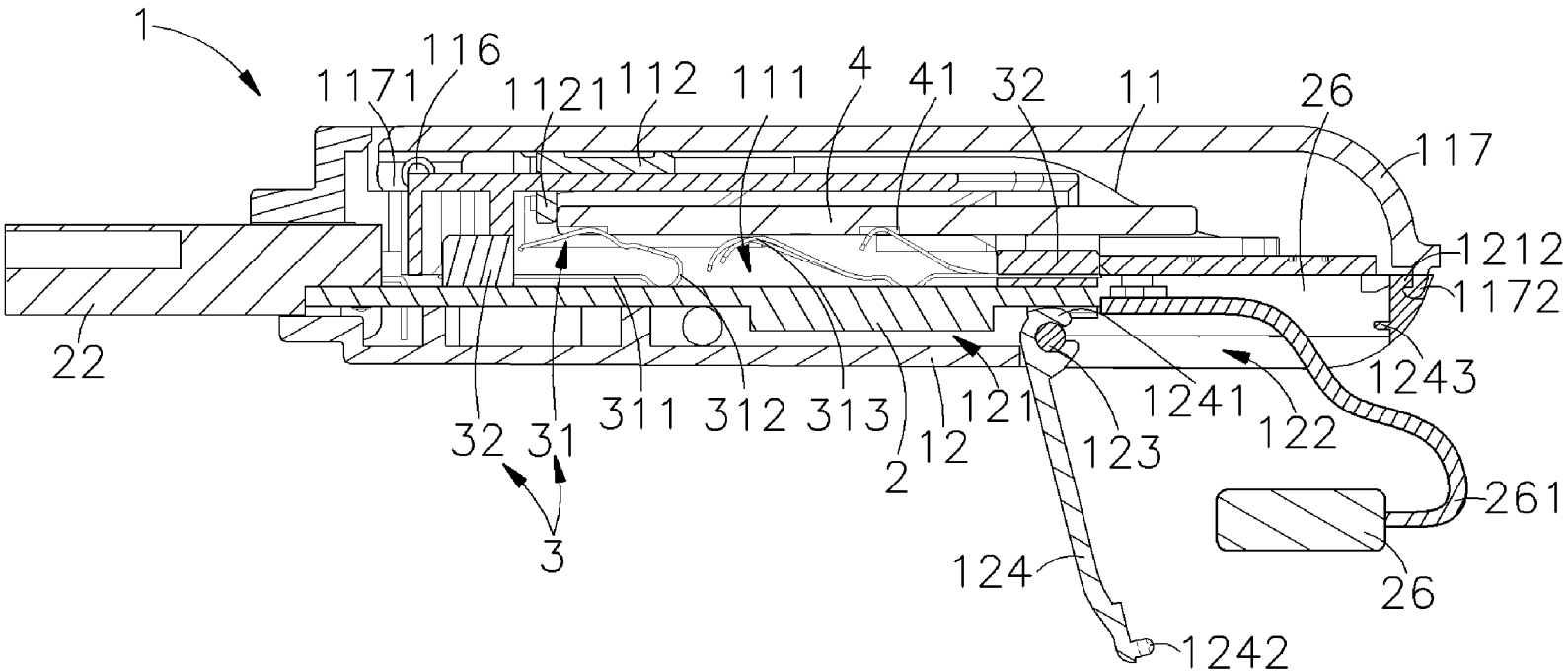
FIG. 8 corresponds to FIG. 7, showing the adapter interface moved out of the receiving space of the housing.

Referring to FIGS. 7 and 8, during the use of the mobile memory card adapter, the connection interface 22 is connected to the connection port of a computer, a human machine interface or an input/output interface of an electronic device so that the computer or the electronic device is accessible to the memory card 4 that is inserted into the housing 1. If the connection port of the computer, the human machine interface or the input/output interface of the electronic device is not compatible to the connection interface 22 but compatible to the adapter interface 26, pull the finger strip 1244 to open the bottom cover 124 from the receiving space 122 of the bottom shell 12 and to disengage the retaining grooves 1242 from the respective retaining blocks 1243, and then take the adapter interface 26 out of the receiving space 122 and unwind the cable 261 from the adapter interface 26 for enabling the adapter interface 26 to be connected to the connection port of the computer, the human machine interface or the input/output interface of the electronic device. By means of the cable 261, the adapter interface 26 can be connected to the connection port of the computer, the human machine interface or the input/output interface of the electronic device at a certain distance.

When the adapter interface 26 is not in use, the adapter interface 26 is received in the receiving space 122 in the bottom shell 12, and then the bottom cover 124 is closed on the bottom shell 12 to force the retaining grooves 1242 into engagement with the respective retaining blocks 1243, and therefore the adapter interface 26 is well protected by the bottom cover 124 against outside dust.

Further, the adapter interface 26 can be an IEEE 1394 connector, USB connector or any of a variety of other signal transmission connectors. The connection interface 22 and the adapter interface 26 can be the same type. Alternatively, the connection interface 22 and the adapter interface 26 can be different interfaces. Further, the memory card 4 can be a CF, SM, MMC, MS, MS Duo, SD or any other type of memory card.

In conclusion, the invention provides a mobile memory card adapter that has the following features and advantages:

1. The mobile memory card adapter has a connection interface 22 and an adapter interface 26 selectively to connect the inserted memory card 4 to a computer or an electronic device.

2. When the adapter interface 26 is not used, the adapter interface 26 can be received in the receiving space 122 in the bottom shell 12 and well protected by the bottom cover 124 against outside dust.

3. When the mobile memory card adapter is not in use, the adapter interface 26 is received in the receiving space 122 of the bottom shell 12 and kept from sight by the bottom cover 124, and the protective end cap 13 is capped on one end of the housing 1 to protect the connection interface 22, and therefore the user can carry the mobile memory card adapter conveniently and safely.

4. By means of the cable 261, the adapter interface 26 is extend able from the circuit board 2 at a distance. When not in use, the cable 261 can be wound around the adapter interface 26 and received with the adapter interface 26 in the receiving space 122 of the bottom shell 12.

5. By means of the insulative block 32, each conducting terminal set 3 can be fastened to the circuit board 2 conveniently without soldering, i.e., the conducting terminal sets 3 are conveniently detachably installed in the circuit board 2. When the conducting terminal sets 3 are installed in the circuit board 2, the metal conducting terminals 31 of the conducting terminal sets 3 are kept in positive connection with the respective conducting contacts 21 of the circuit board 2.

6. The insulative blocks 32 of the conducting terminal sets 3 can be detached from the circuit board 2 for enabling the metal conducting terminals 31 to be directly bonded to the circuit board 2 to fit a different mode of use.

7. The upper shell 11 of the housing 1 has two spring arms 114 that hold down the inserted memory card 4 firmly in position, keeping the metal contacts 41 of the memory card 4 in positive contact with the contact portions 313 of the metal conducting terminals 31 of the corresponding conducting terminal set 3.

8. In case of elastic fatigue of the metal conducting terminals 31 due to a long use, the spring force of the spring arms 114 is still sufficient to hold down the inserted memory card 4 firmly in position, keeping the metal contacts 41 of the memory card 4 in positive contact with the contact portions 313 of the metal conducting terminals 31 of the corresponding conducting terminal set 3.

9. When wishing to take the memory card 4 away from the housing 1, pull the finger rod 1122 of the slide 112 to move the slide 112 toward the outside of the insertion hole 111, and the memory card 4 is forced out of the insertion hole 111 by the slide 112.

Although a particular embodiment of the invention has been described in detail for purposes of illustration, various modifications and enhancements may be made without departing from the spirit and scope of the invention.

What the invention claimed is:

1. A mobile memory card adapter comprising:

a housing, said housing comprising an accommodation chamber, a receiving space, an insertion hole disposed in communication with said accommodation chamber for the insertion of a memory card, a plurality of sliding slots arranged in parallel above and in communication with said insertion hole, and a slide movable along said sliding slots in reversed directions, said slide having a plurality of guide members respectively coupled to said sliding slots and movable by a memory card being inserted into said insertion hole;

a circuit board accommodated in said accommodation chamber of said housing, said circuit board comprising at least one set of conducting contacts, a fixed connection interface outwardly extending from one end thereof and electrically connected to said at least one set of conducting contacts and adapted for connection to an external electronic device, a cable electrically connected with said at least one set of conducting contacts and extendable out of said housing, and a movable adapter interface electrically connected to one end of said cable remote from said at least one set of conducting contacts and adapted for connection to an external electronic device and receivable in said receiving space of said housing; and at least one conducting terminal set installed in said circuit board and respectively electrically kept in contact with said at least one set of conducting contacts of said circuit board, each said conducting terminal set comprising an insulative block fastened to said circuit board and a plurality of metal conducting terminals respectively fastened to said insulative block, said metal conducting terminals each having an elongated base portion respectively fastened to said insulative block, a bearing portion extending from one end of said elongated base portion and disposed in contact with one conducting contact of said circuit board, and a contact portion extended from one end of said bearing portion remote from said elongate base portion and suspending in said insertion hole of said housing for the contact connection of one metal contact of a memory card that is inserted into said insertion hole of said housing.

2. The mobile memory card adapter as claimed in claim 1, wherein said slide comprises a finger rod for grasping by the user to move said slide along said sliding slots and to force the inserted memory card toward the outside of said insertion hole;

said housing further comprises two spring arms bilaterally suspending in said insertion hole at two lateral sides to hold down the inserted memory card.

3. The mobile memory card adapter as claimed in claim 1, wherein said circuit board further comprises a plurality of indicator light inserted into side holes of said housing and adapted for indicating the operation status of said circuit board.

4. The mobile memory card adapter as claimed in claim 1, wherein said circuit board comprises a plurality of retaining grooves symmetrically disposed at two opposite lateral sides thereof and a plurality of mounting holes; the insulative block of each said conducting terminal set comprises a plurality of retaining portions respectively fastened to said retaining grooves of said circuit board, and a plurality of bottom mounting pins respectively fastened to said mounting holes of said circuit board.

5. The mobile memory card adapter as claimed in claim 1, wherein said fixed connection interface is an IEEE 1394 connector.

6. The mobile memory card adapter as claimed in claim 1, wherein said fixed connection interface is an USB connector.

7. The mobile memory card adapter as claimed in claim 1, wherein said movable adapter interface is an IEEE 1394 connector.

8. The mobile memory card adapter as claimed in claim 1, wherein said movable adapter interface is USB connector.

9. The mobile memory card adapter as claimed in claim 1, wherein the insulative block of each said conducting terminal set is directly molded on the elongated base portions of the associating metal conducting terminals.

10. The mobile memory card adapter as claimed in claim 1, wherein said housing comprises a bottom shell, an upper shell covered on said bottom shell, and a top cover pivoted to said upper shell and adapted for closing said upper shell, said bottom shell defining said accommodation chamber and said receiving space and having an opening at a front side of said accommodation chamber for receiving said fixed connection interface and allowing said fixed connection interface to extend out of said housing.

11. The mobile memory card adapter as claimed in claim 10, wherein said upper shell comprises an opening disposed at one end thereof corresponding to said opening of said bottom shell for the passing of said fixed connection adapter, and two pivots bilaterally disposed in said opening of said upper shell; said bottom shell comprises a plurality of locating blocks disposed at one side of said receiving space; said top cover comprises two pivot holes bilaterally disposed at one end thereof and respectively coupled to said pivots of said upper shell and a plurality of retaining blocks disposed at an opposite end thereof and adapted for engaging said locating blocks of said bottom shell.

12. The mobile memory card adapter as claimed in claim 11, wherein said bottom shell comprises two pivots disposed at two opposite lateral sides in said receiving space near said accommodation chamber, two retaining blocks disposed at two opposite lateral sides relative to said locating blocks of said bottom shell, a partition plate transversely disposed in said receiving space near said pivots of said bottom shell, and a wire notch on said partition plate for the passing of said cable of said movable adapter interface; said housing further comprises a bottom cover adapted to close said receiving space of said housing, said bottom cover comprising two pivot holes bilaterally disposed at a rear side thereof and respectively pivotally coupled to said pivots of said bottom shell, two retaining grooves disposed at a front side thereof remote from said pivot holes of said bottom cover for engagement with said retaining blocks of said bottom shell, and a finger strip disposed between said two retaining grooves of said bottom cover for the grasping of the user's fingers to turn said bottom cover relative to said bottom shell between a close position and an open position.

* * * * *